US008443701B1

(12) United States Patent
Liau

(10) Patent No.: US 8,443,701 B1
(45) Date of Patent: May 21, 2013

(54) OPEN WRENCH

(76) Inventor: Jia-Guann Liau, Taichung (TW)

( * ) Notice: Subject to any disclaimer, the term of this patent is extended or adjusted under 35 U.S.C. 154(b) by 2 days.

(21) Appl. No.: 13/350,843

(22) Filed: Jan. 16, 2012

(51) Int. Cl.
*B25B 13/02* (2006.01)

(52) U.S. Cl.
USPC ..... 81/119; 81/121.1

(58) Field of Classification Search
USPC ..... 81/119, 121.1, 125.1, 124.7
See application file for complete search history.

(56) References Cited

U.S. PATENT DOCUMENTS 2,628,522 A * 2/1953 Kraft ..... 81/125.1
2012/0167724 A1* 7/2012 Keong et al. ..... 81/119

* cited by examiner

*Primary Examiner* — Monica Carter
*Assistant Examiner* — Melanie Alexander

(57) ABSTRACT

An open wrench includes a handle which is flat relative to a horizontal plane and a driving head is connected to the head. The driving head has a clamping opening with an opening communicating therewith. The driving head has two flat portions located on top and bottom of the driving head respectively and the flat portions each have an outer face, an inner face and a recess, all of which are located around the clamping opening and arranged in U shape. The inner face is located close to the clamping opening and the outer face is located close to the inner face. The outer face is raised, relative to the horizontal plane, from the mediate portion thereof and toward two ends of the outer face so as to define an inclined angle between the outer face and the horizontal plane.

13 Claims, 10 Drawing Sheets

OPEN WRENCH

FIELD OF THE INVENTION

The present invention relates to an open wrench, and more particularly, to an open wrench which has a flat head with outer face, inner face and a recess.

BACKGROUND OF THE INVENTION

The conventional open wrench generally includes a driving head connected to the handle and the driving head has a clamping opening so as to be mounted to the head of a bolt. In order to increase the durability of the driving head and reduces the material and weight, there are two recesses located at the bottom of the two clamping arms of the driving head. Although the open wrench has the two recesses defined in the bottom of the two clamping arms, the strength of the wrench is still not satisfied.

The present invention intends to provide an open wrench which has lightweight and the material required is less than the conventional wrenches.

SUMMARY OF THE INVENTION

The present invention relates to an open wrench includes a handle which is flat relative to a horizontal plane and a driving head is connected to the head. The driving head has a clamping opening with an opening communicating therewith. The driving head has two flat portions located on top and bottom of the driving head respectively and the flat portions each have an outer face, an inner face and a recess, all of which are located around the clamping opening and arranged in U shape. The inner face is located close to the clamping opening and the outer face is located close to the inner face. The outer face is raised, relative to the horizontal plane, from the mediate portion thereof and toward two ends of the outer face so as to define an inclined angle between the outer face and the horizontal plane.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
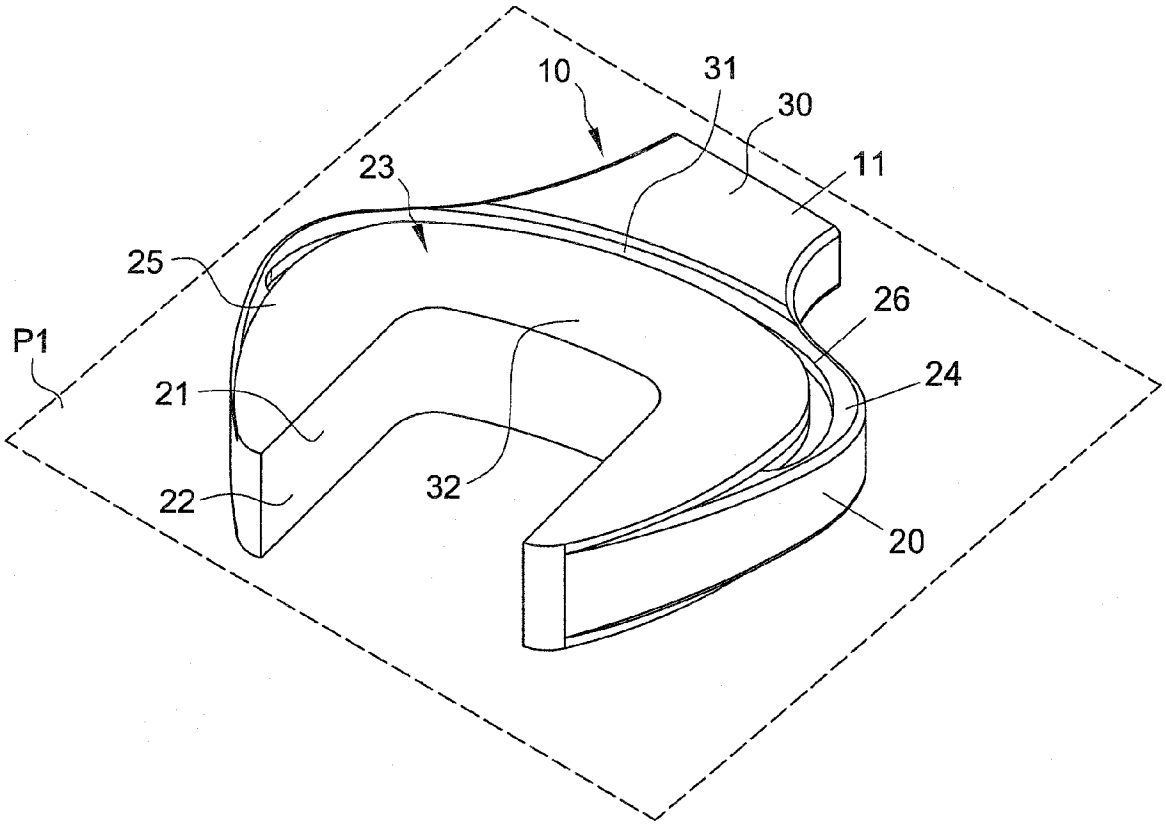
FIG. 1 is a perspective view to show the open wrench of the present invention.
Figure 3:
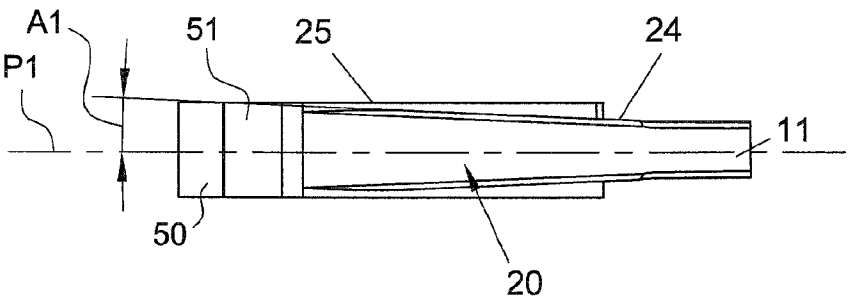
FIG. 3 is the side view of the open wrench of the present invention.
Figure 4:
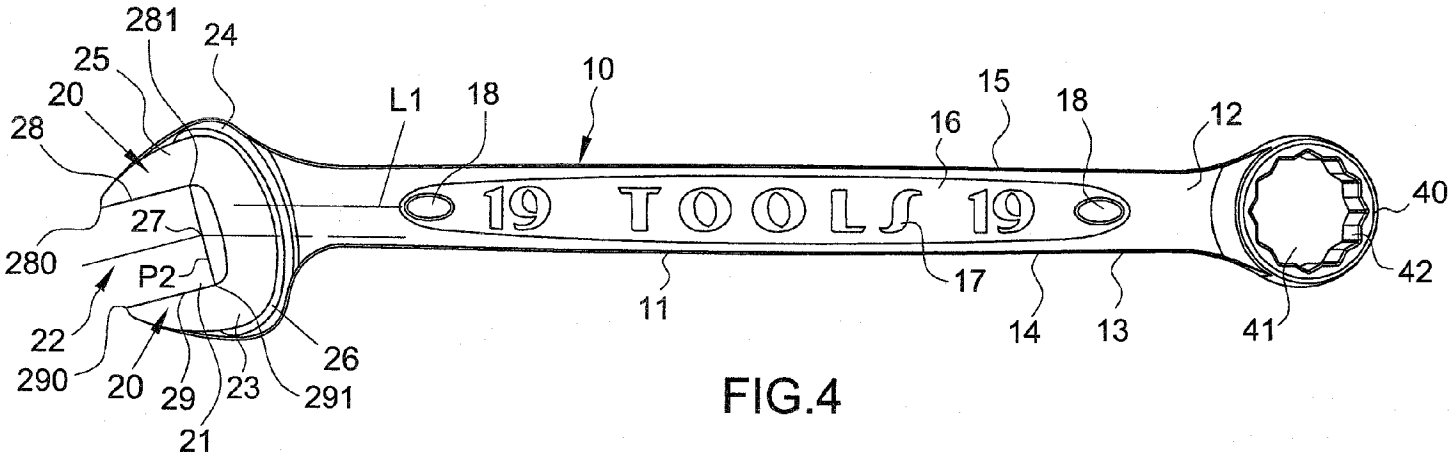
FIG. 4 is the top view of the second embodiment of the open wrench of the present invention.
Figure 5:
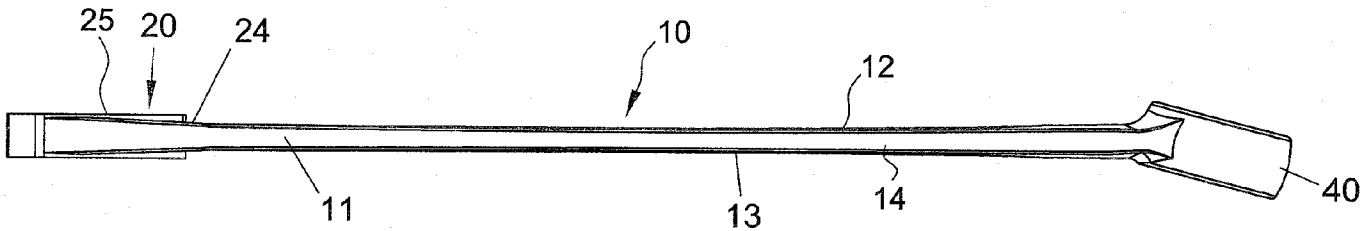
FIG. 5 is the side view of the second embodiment of the open wrench of the present invention.
Figure 6:
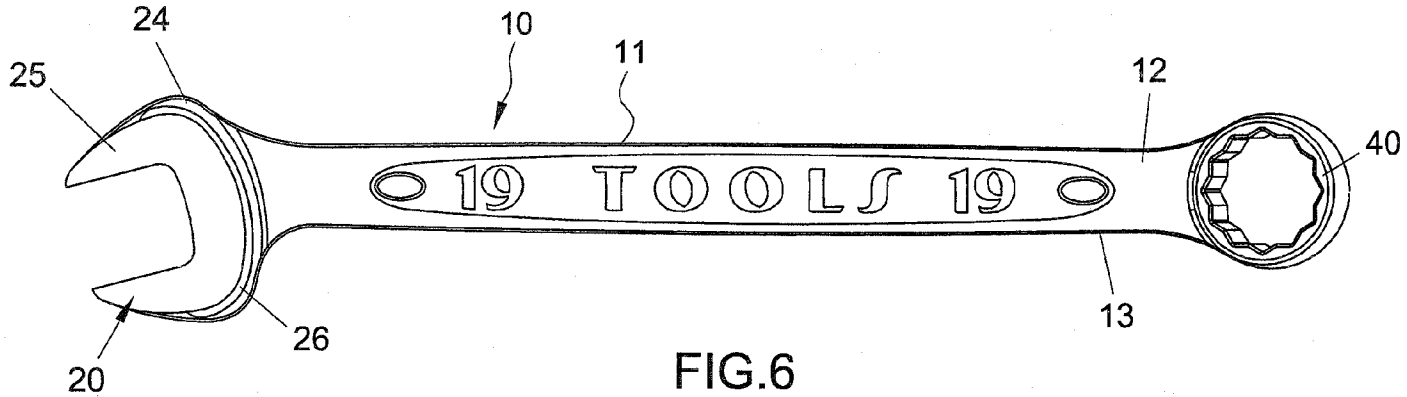
FIG. 6 is the top view of the third embodiment of the open wrench of the present invention.
Figure 7:
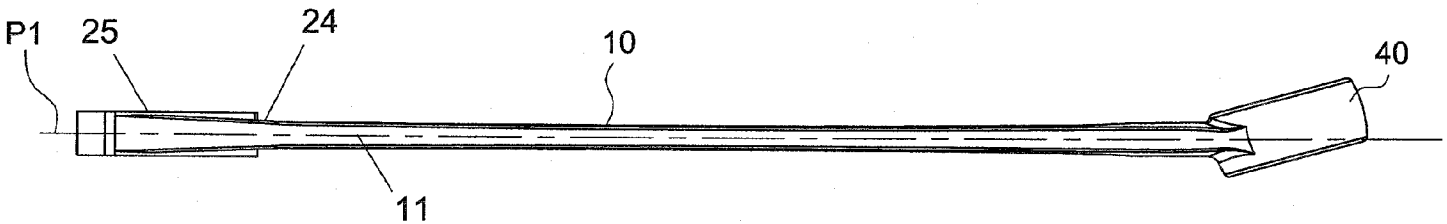
FIG. 7 is the side view of the third embodiment of the open wrench of the present invention.

Referring to FIGS. 1, 4 and 5, the open wrench 10 of the present invention comprises a handle 11 which is flat relative to a horizontal plane P1, a first driving head 20 is connected to the first end of the head 11. The handle 11 has two first flat portions 12, 13 respectively located on top and bottom thereof, and two sides 14, 15 on two sides of the handle 11. At least one of the first flat portions 12, 13, in this embodiment, the first flat portion 12 has a recessed portion 16 and a display portion 17 is defined in the recessed portion 16. The top of the display portion 17 is in flush with or slightly higher than the first flat portion 12. The display portion 17 can be word contents, patterns, specifications, sizes or logos. The first driving head 20 has a clamping opening 21 with which a hexagonal head 51 of a bolt 50 can be clamped. The axis of the clamping opening 21 is perpendicular to the horizontal plane P1. An opening 22 communicates with the clamping opening 21 and located at the front end of the first driving head 20. The first driving head 20 has two second flat portions 23 which are located on top and bottom of the driving head 20 respectively and symmetric relative to the horizontal plane P1. The second flat portions 23 each have an outer face 24, an inner face 25 and a recess 26. The outer face 24, the inner face 25 and the recess 26 are located around the clamping opening 21 and arranged in U shape. The inner face 25 is located close to the clamping opening 21 and the outer face 24 is located close to the inner face 25. The recess 26 is located at a conjunction portion between the inner face 25 and the outer face 24. The outer face 24 is higher than the handle 11 and the inner face 25 is higher than the outer face 24. By the recess 26, the amount of the material required and weight of the wrench are reduced.

As shown in FIG. 1, the inner face 25 is parallel to the horizontal plane P1. The outer face 24 is raised, relative to the horizontal plane P1, from the mediate portion thereof and toward two ends of the outer face 24. A first inclined angle A1 is defined between the outer face 24 and the horizontal plane P1. The first inclined angle A1 is in a range between 1 to 3.5 degrees. Preferably, the first inclined angle A1 is 2.42 degrees. The clamping opening 21 has two parallel clamping surfaces 28, 29 which respectively have a first end face 280/290 and a second end face 281/291. The first end faces 280, 290 extend to the opening 22 and the second end faces 281, 291 are located on a common vertical plane P2. The middle point 27 between the second end faces 281, 291 is located on the vertical plane P2. The minimum distance from the middle point 27 to the central axis L1 of the handle 11 is a shift distance H2. The shift distance H2 is between 2 to 7 mm, and preferably, the shift distance H2 is 5 mm. The included angle between the two clamping surfaces 28, 29 and the central axis L1 is about 28 degrees.

As shown in FIGS. 4 to 7, a second driving head 40 is connected to the second end of the handle 11 and the second driving head 40 is inclined an angle relative to the horizontal plane P1. The second driving head 40 has an enclosed mounting hole 41 which has multiple protrusions 42 extending from an inner periphery thereof.

Figure 8:
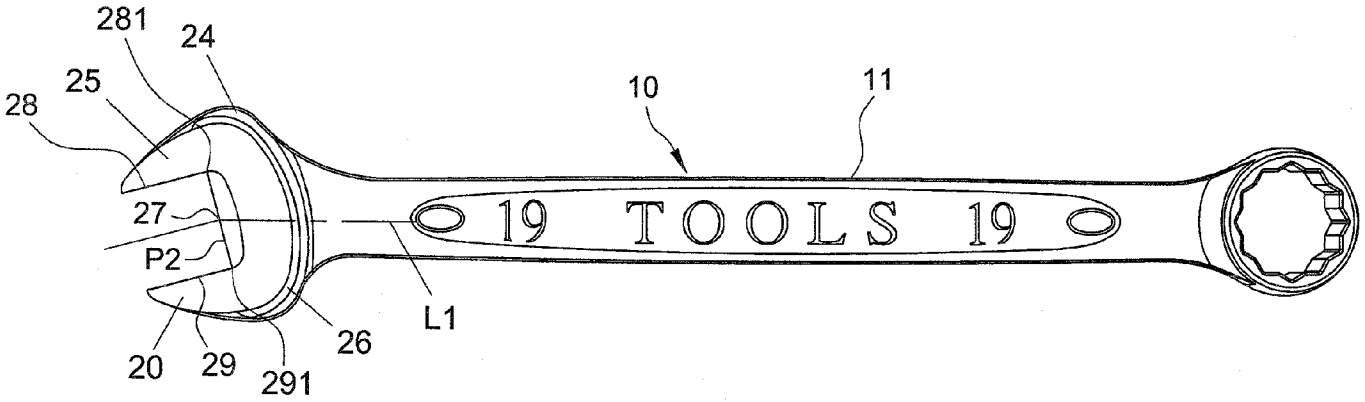
FIG. 8 is the top view of the fourth embodiment of the open wrench of the present invention.
Figure 9:
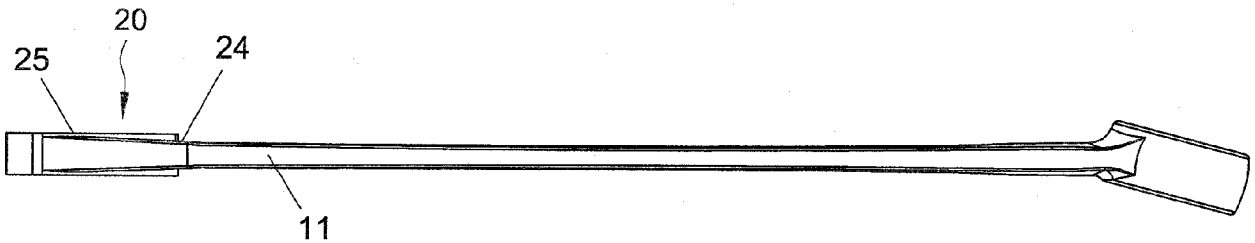
FIG. 9 is the side view of the fourth embodiment of the open wrench of the present invention.

As shown in FIGS. 8 and 9, the middle point 27 between the second end faces 281, 291 of the two clamping surfaces 28, 29 is located on the central axis L1 of the handle 11.

Figure 10:
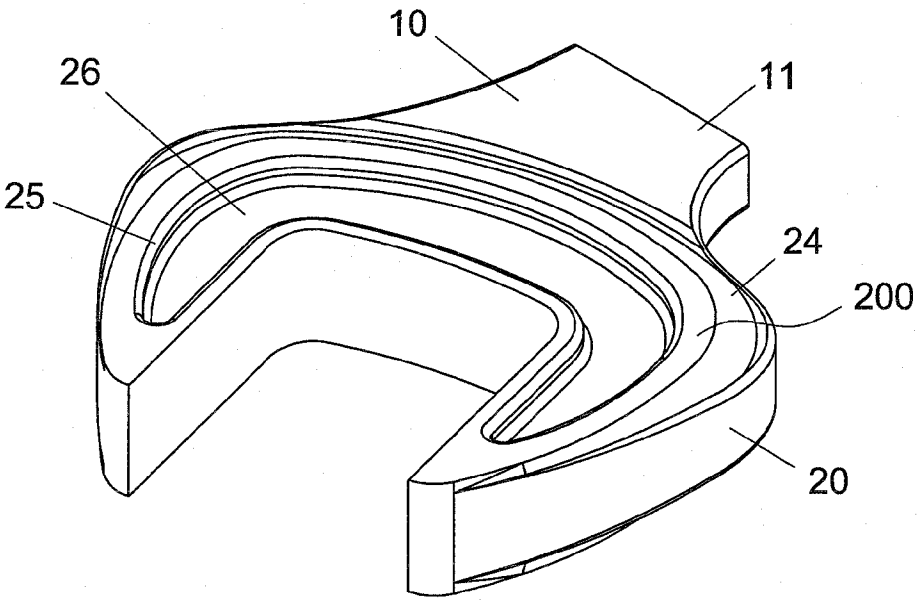
FIG. 10 is a perspective view of the fifth embodiment of the open wrench of the present invention.

As shown in FIG. 10, the recess 26 is located in the inner face 25, and a curved surface 200 is connected between the inner face 25 and the outer face 24.

Figure 11:
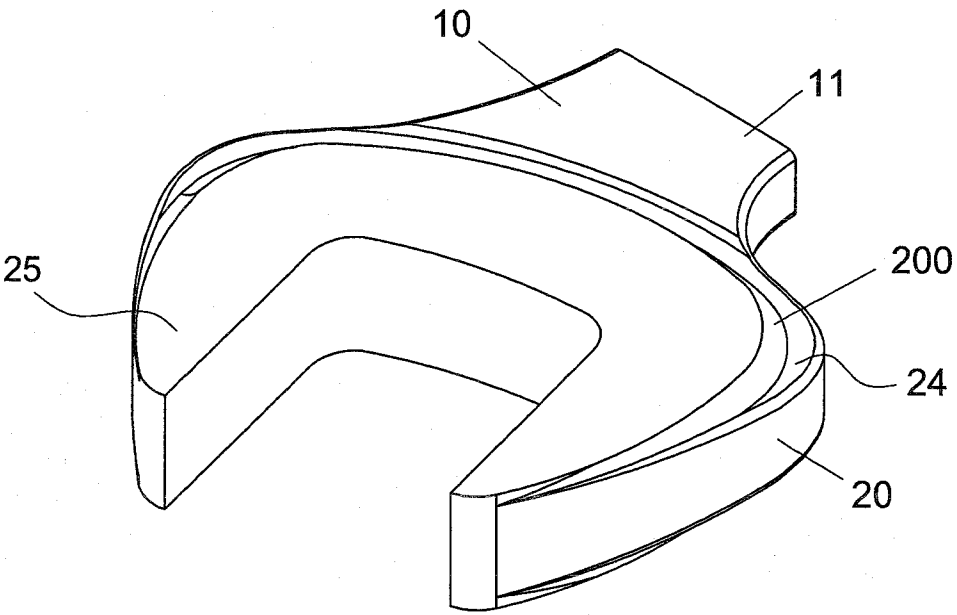
FIG. 11 is a perspective view of the sixth embodiment of the open wrench of the present invention.

As shown in FIG. 11, the second flat portion 23 does not have the recess 26, and a curved surface 200 is connected between the inner face 25 and the outer face 24.

Figure 13:
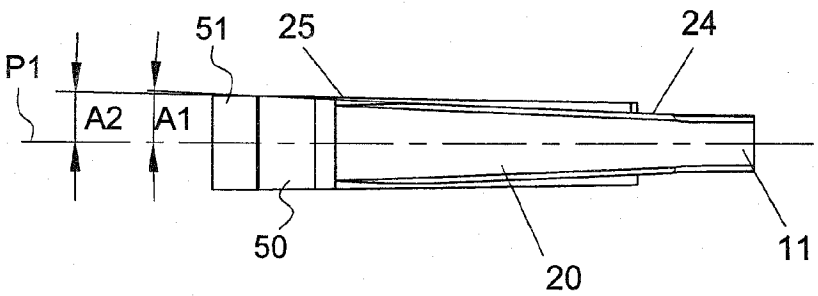
FIG. 13 is the side view of the seventh embodiment of the open wrench of the present invention.
Figure 12:
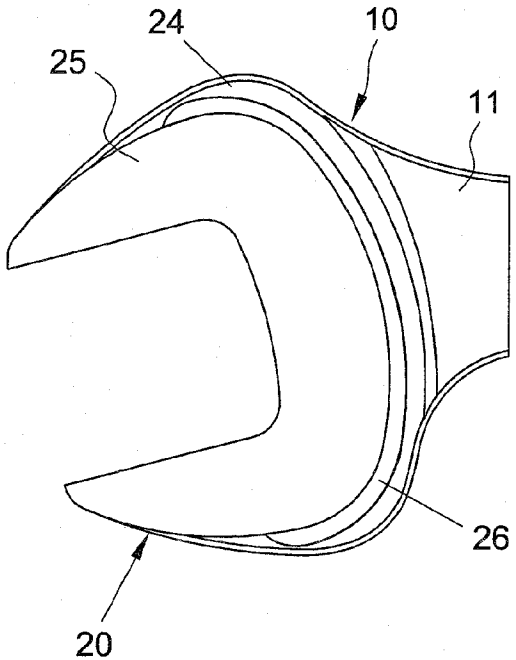
FIG. 12 is the top view of the seventh embodiment of the open wrench of the present invention.

As shown in FIGS. 12 and 13, the inner face 25 is raised from the mediate portion thereof and toward two ends of the inner face 25. A second inclined angle A2 is defined between the inner face 25 and the horizontal plane P1. The second inclined angle A2 is 0.88 degrees. The second inclined angle A2 is smaller than the first inclined angle A1.

Figure 2:
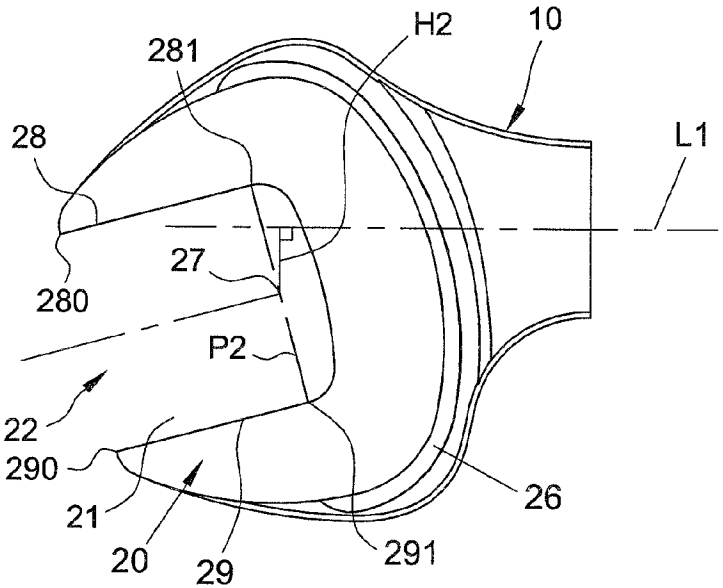
FIG. 2 is the top view of the open wrench of the present invention.
Figure 14:
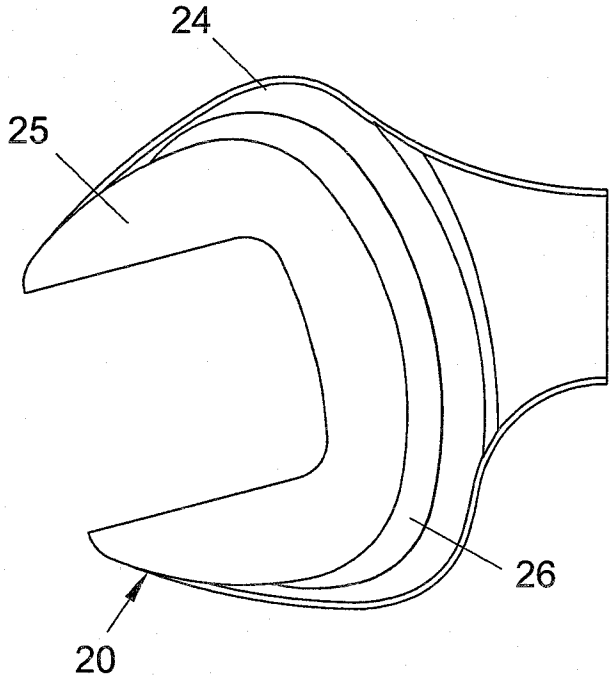
FIG. 14 is the top view of the eighth embodiment of the open wrench of the present invention.

As shown in FIGS. 2 and 14, the cross sectional area of the inner face 25 in FIG. 14 is smaller than the cross sectional area of the inner face 25 in FIG. 2.

Figure 15:
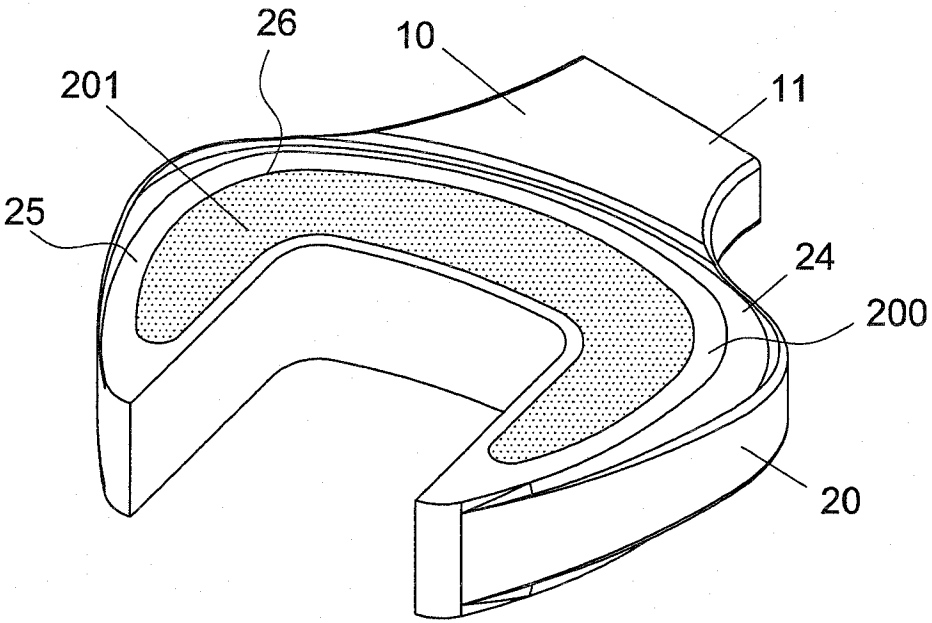
FIG. 15 is a perspective view of the ninth embodiment of the open wrench of the present invention.

As shown in FIG. 15, the recess 26 is filled by stuffing material 201 which can be made by plastic material and has different color from that of the first driving head 20.

As shown in FIG. 1, when using the open wrench 10, there is a first coated layer 30 of first color is coated on the surface of the wrench 10, and the first coated layer 30 is removed a the inner face 25 to form a blank portion 31. A second coated layer 32 of second color is then coated to the inner face 25 via the blank portion 31 so that the first driving head 20 has two different colors to have better aesthetic feature. As shown in FIG. 4, the recess 16 has two holes 18 defined therethrough which are located close to the two ends of the handle 11.

While we have shown and described the embodiment in accordance with the present invention, it should be clear to those skilled in the art that further embodiments may be made without departing from the scope of the present invention.

What is claimed is:

1. An open wrench comprising:

a handle which is flat relative to a horizontal plane, a first driving head connected to a first end of the head and having a clamping opening with which a hexagonal head of a bolt being clamped, an axis of the clamping opening being perpendicular to the horizontal plane, an opening communicating with the clamping opening and located at a front end of the first driving head, the first driving head having two second flat portions which are located on top and bottom of the driving head respectively and symmetric relative to the horizontal plane, the second flat portions each having an outer face, an inner face and a recess, the outer face, the inner face and the recess located around the clamping opening and arranged in U shape, the inner face located close to the clamping opening and the outer face located close to the inner face, the outer face being higher than the handle, the inner face being higher than the outer face, the outer face being raised, relative to the horizontal plane, from a mediate portion thereof and toward two ends of the outer face, a first inclined angle being defined between the outer face and the horizontal plane, the first inclined angle being in a range between 1 to 3.5 degrees.

2. The open wrench as claimed in claim 1, wherein the first inclined angle is 2.42 degrees.

3. The open wrench as claimed in claim 1, wherein the recess is located in the inner face, a curved surface is connected between the inner face and the outer face.

4. The open wrench as claimed in claim 1, wherein the recess is located at a conjunction portion between the inner face and the outer face.

5. The open wrench as claimed in claim 1, wherein the inner face is parallel to the horizontal plane.

6. The open wrench as claimed in claim 1, wherein the inner face is raised from a mediate portion thereof and toward two ends of the inner face, a second inclined angle is defined between the inner face and the horizontal plane, the second inclined angle is smaller than the first inclined angle.

7. The open wrench as claimed in claim 1, wherein the second inclined angle is 0.88 degrees.

8. The open wrench as claimed in claim 1, wherein the recess is filled by stuffing material which has different color from that of the first driving head.

9. The open wrench as claimed in claim 1, wherein the clamping opening has two parallel clamping surfaces which respectively have a first end face and a second end face, the first end faces extend to the opening and the second end faces are located on a common vertical plane, a middle point between the second end faces is located on the vertical plane, a minimum distance from the middle point to a central axis of the handle is a shift distance.

10. The open wrench as claimed in claim 9, wherein the shift distance is between 2 to 7 mm.

11. The open wrench as claimed in claim 10, wherein the shift distance is 5 mM.

12. The open wrench as claimed in claim 1, wherein a second driving head is connected to a second end of the handle and has an enclosed mounting hole which has multiple protrusions extending from an inner periphery thereof.

13. The open wrench as claimed in claim 12, wherein the second driving head is inclined an angle relative to the horizontal plane.

* * * * *